US005299104A

United States Patent [19]

Parmentier

[11] Patent Number: 5,299,104

[45] Date of Patent: Mar. 29, 1994

[54] SHAVING LIGHT APPARATUS

[76] Inventor: Theresa A. Parmentier, 6100 Wilderness Ave., Cocoa, Fla. 32927

[21] Appl. No.: 38,818

[22] Filed: Mar. 29, 1993

[51] Int. Cl.[5] ..... B26B 19/46

[52] U.S. Cl. ..... 362/115; 362/32; 362/396; 30/34.05

[58] Field of Search ..... 362/115, 109, 32, 396; 30/34.05, 86

[56] References Cited

U.S. PATENT DOCUMENTS

| | | | |
|---|---|---|---|
| 1,180,686 | 4/1916 | Allport | 362/115 |
| 1,440,325 | 12/1922 | Wilhelm | 362/115 |
| 1,862,274 | 6/1932 | Mendelsohn | 362/115 |
| 2,195,423 | 4/1940 | Powell | 362/115 |
| 3,121,286 | 2/1964 | Schneiderman | 30/34.05 |

FOREIGN PATENT DOCUMENTS

| | | | |
|---|---|---|---|
| 768429 | 4/1934 | France | 362/115 |

*Primary Examiner*—James C. Yeung
*Attorney, Agent, or Firm*—Leon Gilden

[57] ABSTRACT

A support plate mounting a tubular handle at a support plate first end includes an illumination member within the handle directing illumination through the support plate and projecting illumination from a fiber optic cable structure directed through the support plate for projection through an associated razor assembly to provide for illumination during a shaving procedure.

3 Claims, 4 Drawing Sheets

SHAVING LIGHT APPARATUS

BACKGROUND OF THE INVENTION

1. Field of the Invention

The field of invention relates to shaving apparatus, and more particularly pertains to a new and improved shaving light apparatus arranged to employ an illumination structure in association with a razor during a shaving procedure.

2. Description of the Prior Art

Illuminated razor structure is indicated in the prior art in U.S. Pat. No. 4,473,943 wherein the razor includes a handle directing illumination through the razor handle itself, wherein in contrast the instant invention employs a support plate structure mounting the razor for providing for illumination in conjunction in use of the razor structure and in this respect, the present invention substantially fulfills this need.

SUMMARY OF THE INVENTION

In view of the foregoing disadvantages inherent in the known types of razor apparatus now present in the prior art, the present invention provides a shaving light apparatus wherein the same employs an illumination structure in association with a razor assembly. As such, the general purpose of the present invention, which will be described subsequently in greater detail, is to provide a new and improved shaving light apparatus which has all the advantages of the prior art razor apparatus and none of the disadvantages.

To attain this, the present invention provides a support plate mounting a tubular handle at a support plate first end, including an illumination member within the handle directing illumination through the support plate and projecting illumination from a fiber optic cable structure directed through the support plate for projection through an associated razor assembly to provide for illumination during a shaving procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shaving light apparatus which has all the advantages of the prior art razor apparatus and none of the disadvantages.

It is another object of the present invention to provide a new and improved shaving light apparatus which may be easily and efficiently manufactured and marketed.

It is a further object of the present invention to provide a new and improved shaving light apparatus which is of a durable and reliable construction.

An even further object of the present invention is to provide a new and improved shaving light apparatus which is susceptible of a low cost of manufacture with regard to both materials and labor, and which accordingly is then susceptible of low prices of sale to the consuming public, thereby making such shaving light apparatus economically available to the buying public.

Still yet another object of the present invention is to provide a new and improved shaving light apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a diagrammatic electrical illustration relative to the illumination mounted within the tubular handle of the support apparatus.

FIG. 4 is an isometric illustration of the invention.

DESCRIPTION OF THE PREFERRED EMBODIMENT

Figure 1:
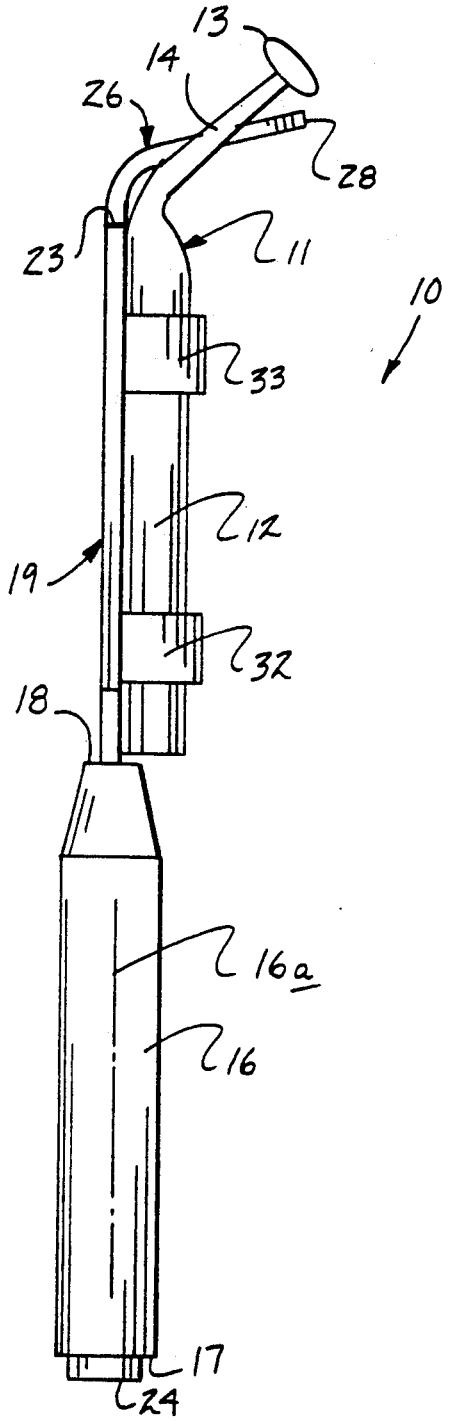
FIG. 1 is an orthographic side view of the invention.
Figure 2:
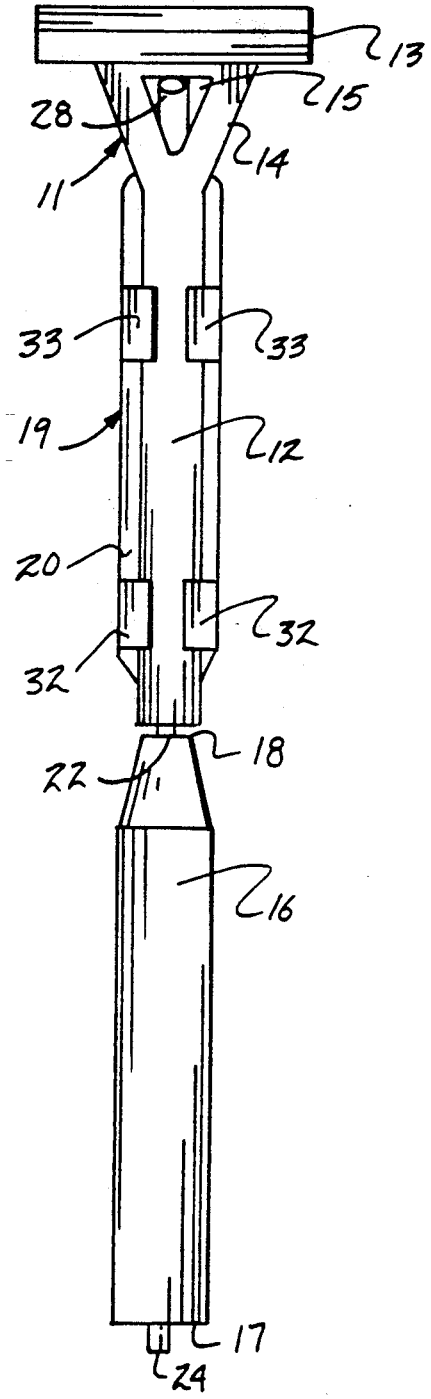
FIG. 2 is an orthographic frontal view of the invention.
Figure 11:
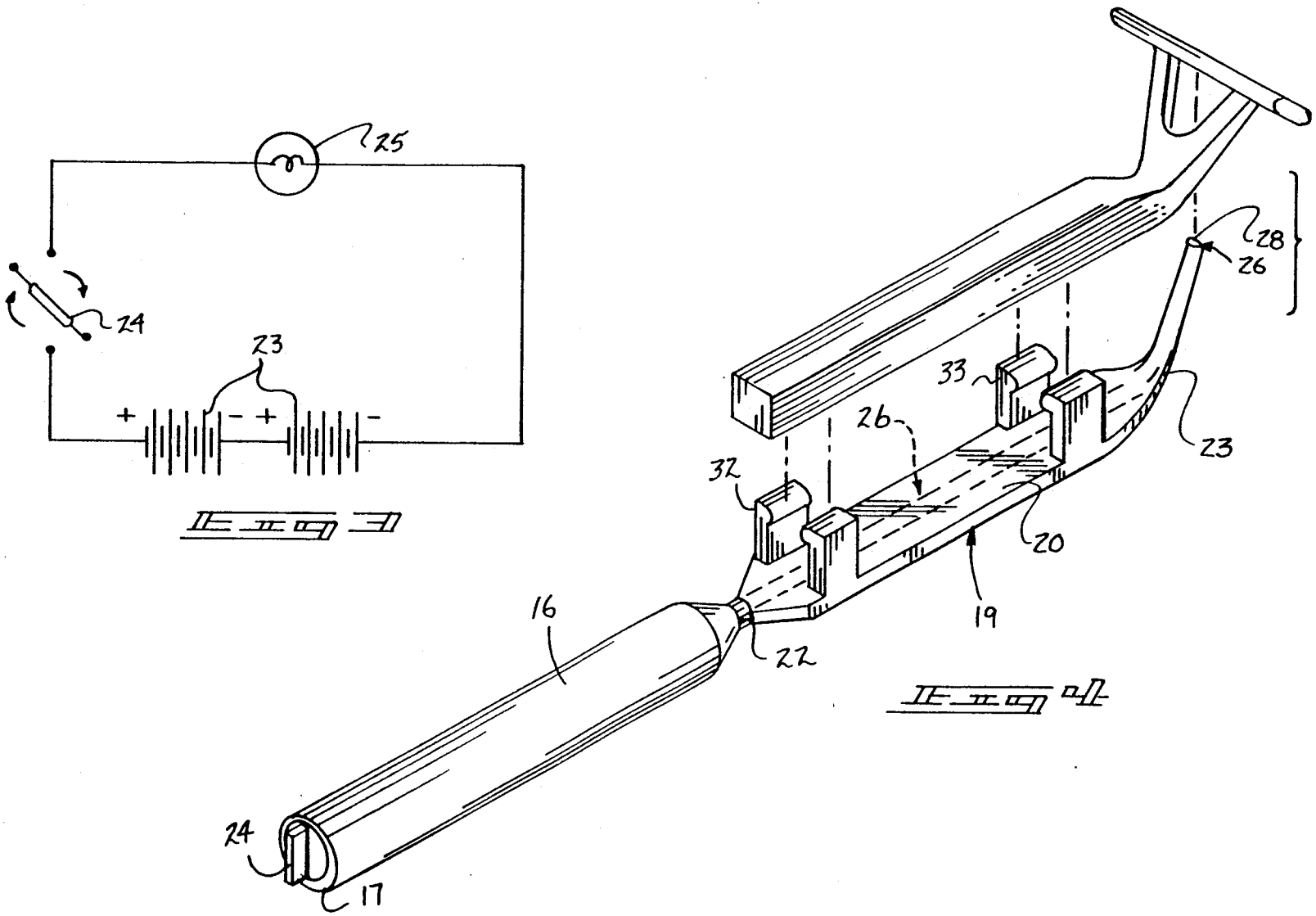
Figure 5:
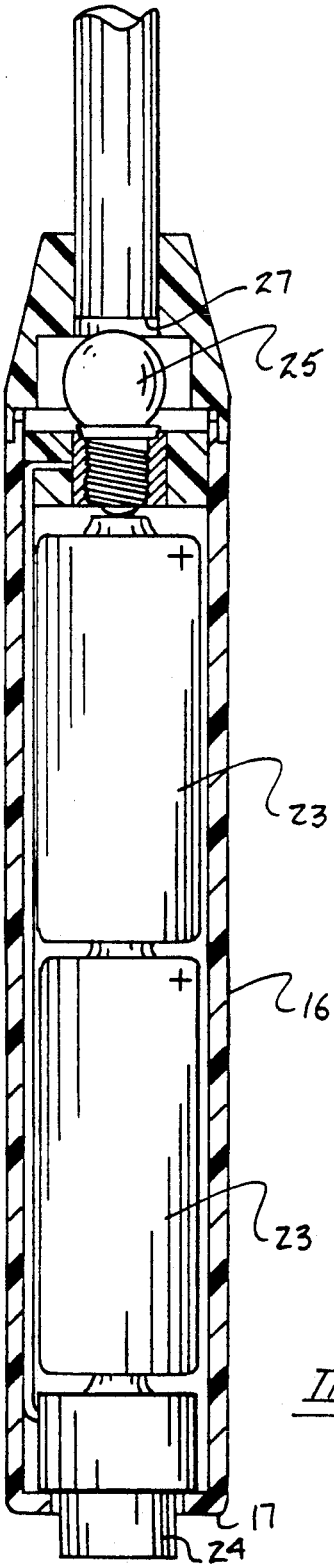
FIG. 5 is an orthographic cross-sectional view of the handle portion of the invention.

With reference now to the drawings, and in particular to FIGS. 1 to 8 thereof, a new and improved shaving light apparatus embodying the principles and concepts of the present invention and generally designated by the reference numeral 10 will be described.

More specifically, the shaving light apparatus 10 of the instant invention essentially comprises a razor assembly 11 having a razor handle 12 and a razor head 13, including an elongate substantially planar cutting edge, with the razor handle 12 including a bifurcated support 14 extending from the razor handle 12 to the razor head 13, and the bifurcated support 14 defining a gap 15. A tubular handle 16 is provided, having a handle first end and a handle second end. A support plate 19 extends from the handle second end, with the tubular handle oriented about a handle axis 16*a*. A support plate 19 is fixedly mounted to the handle second end 18, including a support side wall 20 bisected and coincident with the handle axis 16*a*. The support plate includes a support plate second end 22 having projecting therefrom a fiber optic cable member 26, that includes a fiber optic cable member first end 27 directed into the tubular handle 16 through the handle first end 17, with the fiber optic cable member having a fiber optic cable second end 28 extending through the gap 15 in adjacency to the razor head 13. Respective first and second pairs of L-shaped mounting clips 32 and 33 respectively are arranged to resiliently secure the razor handle 12 as the first pair of L-shaped mounting clips 32, as well as the second pair of L-shaped mounting clips 33, are arranged in a facing relationship relative to one another in a biased mirror image relationship to secure the handle structure, in a manner as indicated in FIG. 4 for example. The tubular handle 16 includes at least one, and typically a plurality of, battery members 23 positioned within the tubular handle 16. An on/off switch 24 is mounted to the handle first end 17, wherein in adjacency to the handle second end, an illumination bulb 25 is mounted in electrical communication with the battery members 23 through the on/off switch 24, wherein the illumination bulb 25 is positioned in adjacency to the fiber optic cable member first end 27 to direct illumination therethrough for providing illumination during a shaving procedure.

Figure 6:
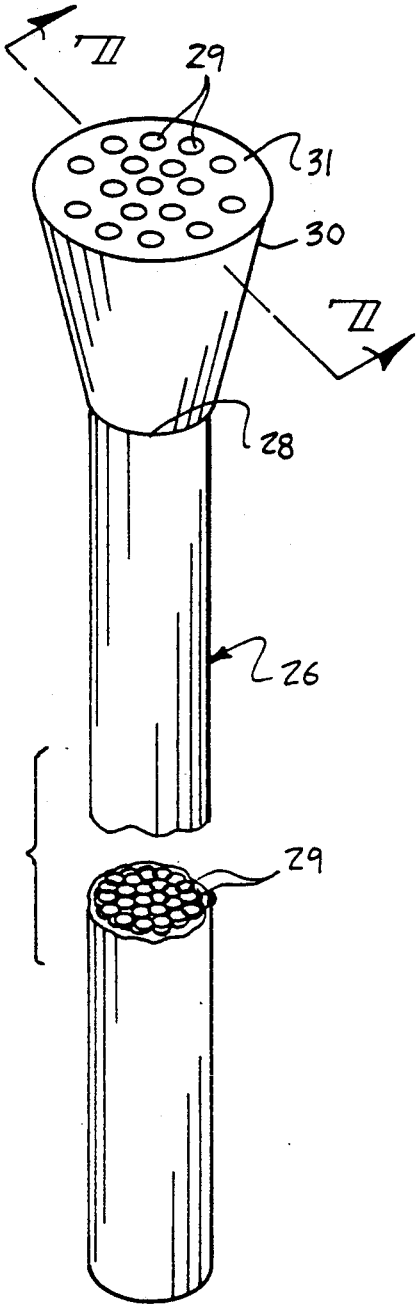
FIG. 6 is an isometric illustration of the fiber optic cable structure employing a diffuser head.
Figure 8:
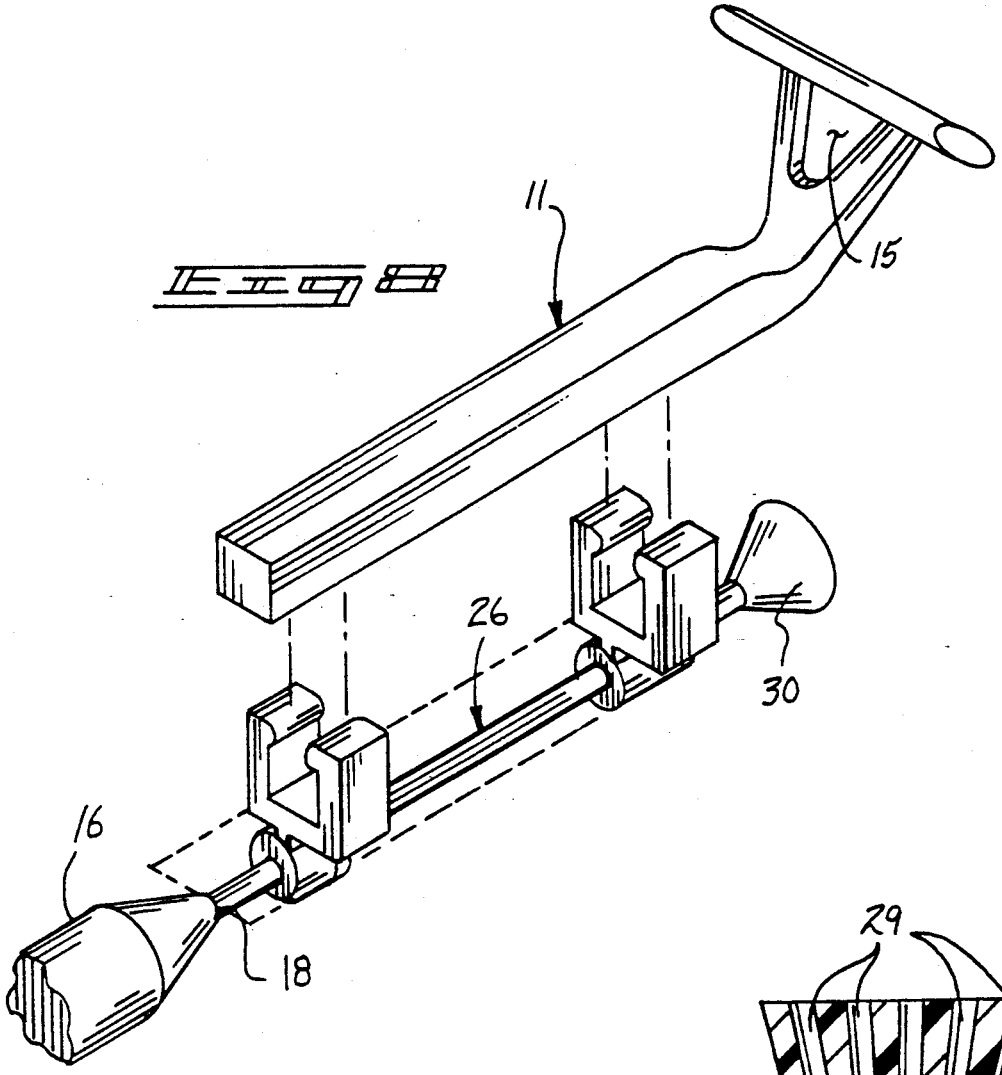
FIG. 8 is an isometric illustration of the razor assembly arranged for securement to the support structure.
Figure 7:
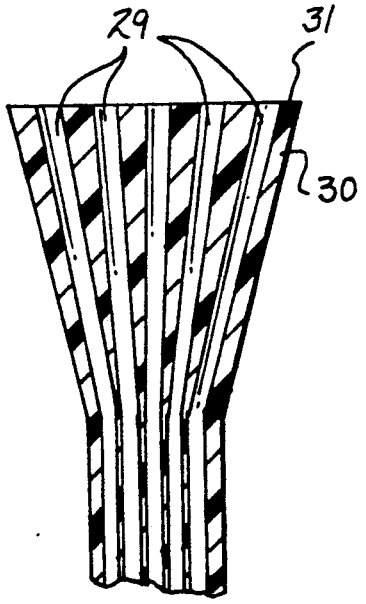
FIG. 7 is an orthographic view, taken along the lines 7—7 of FIG. 6 in the direction indicated by the arrows.

The FIGS. 6 and 7 for example include a truncated conical diffuser head 30 formed of compressible material arranged for reception through the gap 15, wherein the diffuser head 30 includes a face plate 31 providing for an array of the individual fiber optic cable free ends to provide for enlarged surface area of illumination during use of the organization. The face plate 31 is substantially of a first diameter, wherein the cable member 26 is of a second diameter less than the first diameter to provide for the enlarged illumination of the structure in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shaving light apparatus, comprising, a razor assembly, having a razor handle, and a razor head, with a bifurcated support extending from the razor handle to the razor head, and the bifurcated support having a gap directed through the bifurcated support, and further including an elongated tubular handle having a handle first end spaced from a handle second end, and the tubular handle oriented symmetrically about a handle axis, with a support plate fixedly mounted to the handle second end, the support plate having a support plate first end spaced from a support plate second end, with the support plate second end mounted to the handle second end, and a support plate planar side wall, wherein the support plate planar side wall includes the handle axis directed medially and coextensively therethrough, and illumination means contained within the tubular handle and extending from the tubular handle second end through the support plate and through the gap in adjacency to the razor head for providing illumination in adjacency to the razor head, and securement means for securing the razor handle to the support plate, and the illumination means includes a fiber optic cable member having a cable member first end spaced from a cable member second end, the cable member is directed through the support plate extending from the support plate first end to the support plate second end, and the fiber optic cable member first end is directed into the tubular handle through the tubular handle second end, and the fiber optic cable member second end is oriented in adjacency to the razor head between the razor head and the support plate in adjacency to the razor head, with the fiber optic cable member directed through the gap, and an on/off switch mounted within the tubular handle, and at least one battery member mounted within the tubular handle, and an illumination bulb mounted within the tubular handle in adjacency to the tubular handle second end in adjacency to the fiber optic cable member first end to direct selective illumination through the fiber optic cable member.

2. An apparatus as set forth in claim 1 the securement means including a plurality of first L-shaped mounting clips orthogonally and fixedly secured to the support plate, wherein the first L-shaped mounting clips are arranged in a mirror image facing relationship biased towards one another, and a plurality of second L-shaped mounting clips fixedly and orthogonally mounted to the support plate and oriented parallel to the first L-shaped mounting clips, wherein the first L-shaped mounting clips and the second L-shaped mounting clips secure the razor handle.

3. An apparatus as set forth in claim 2 wherein the fiber optic cable second end includes a truncated conical diffuser head having a face plate, and the fiber optic cable member includes a plurality of fiber optic cables directed therethrough, with each of the fiber optic cables having fiber optic cable first ends positioned in adjacency to the illumination member, and fiber optic cable second ends directed through the diffuser head and coplanar with the face plate, with the face plate having a first diameter and the fiber optic cable member having a second diameter less than the first diameter, and wherein the truncated conical diffuser head is compressible for projection through the gap.

* * * * *